United States Patent [19]

Valayil et al.

[11] Patent Number: 4,467,067

[45] Date of Patent: Aug. 21, 1984

[54] ELECTROLESS NICKEL PLATING

[75] Inventors: Silvester P. Valayil, Shrewsbury; Vita Aronson, Worcester, both of Mass.

[73] Assignee: Shipley Company, Newton, Mass.

[21] Appl. No.: 554,397

[22] Filed: Nov. 22, 1983

Related U.S. Application Data

[63] Continuation-in-part of Ser. No. 453,816, Dec. 27, 1982, abandoned.

[51] Int. Cl.[3] ..... C08K 3/08

[52] U.S. Cl. ..... 524/435; 526/287; 427/92; 427/98; 427/435; 427/438

[58] Field of Search ..... 526/287; 427/92, 98, 427/43; 524/435

[56] References Cited

U.S. PATENT DOCUMENTS 3,420,680 1/1969 Gulla .
3,547,899 12/1970 Arit et al. .

*Primary Examiner*—Joseph L. Schofer
*Assistant Examiner*—J. M. Reddick

[57] ABSTRACT

An electroless nickel plating composition characterized by the addition of a polymer formed from a 2-acrylamido or 2-methacrylamido alkyl sulfonic acid monomer. The polymer additive increases the rate of deposition from solution, and to a minor extent, improves the appearance of a nickel deposited from the solution.

14 Claims, No Drawings

ELECTROLESS NICKEL PLATING

CROSS REFERENCE TO RELATED APPLICATIONS

The subject application is a continuation-in-part of copending U.S. patent application Ser. No. 06/453,816 filed Dec. 27, 1982 now abandoned.

BACKGROUND OF THE INVENTION

1. Introduction

This invention relates to electroless metal plating and more particularly to a means for increasing the plating rate of an electroless nickel plating solution.

2. Description of the Prior Art

Electroless metal deposition refers to the chemical plating of a metal over an active surface by chemical reduction in the absence of an external electric current. Processes and compositions useful therefore are known, are in substantial commercial use, and are described in numerous publications. For example, compositions for depositing electroless nickel are described in U.S. Pat. Nos. 2,690,401; 2,690,402; 2,762,723; 2,935,424; 2,929,742; 3,338,726; 3,420,680 and 3,515,564, all incorporated herein by reference.

Known electroless nickel deposition solutions generally comprise at least four ingredients dissolved in a solvent, typically water. They are (1) a source of nickel ions, (2) a reducing agent for the nickel ions such as a hypophosphite, (3) an acid or hydroxide pH adjustor to provide required pH, and (4) a complexing agent for the nickel ions sufficient to prevent precipitation in solution. A large number of suitable complexing agents for electroless nickel solutions are described in the aforesaid U.S. Patents. In some formulations, a complexing agent is helpful but not a necessity.

In addition to the basic additives comprising the electroless nickel solution as described above, other additives are routinely added to such solutions in minor amount. These additives comprise, for example, stabilizers to prevent spontaneous decomposition of the solution, brightners to improve deposit appearance exaltants to improve plating rate and the like.

Though plating solutions of the type described have been brought to a high level of development, considerable efforts are still made to further improve such solutions.

SUMMARY OF THE INVENTIONS

The subject invention provides an electroless plating solution characterized by an increased plating rate and a nickel deposit having somewhat improved physical properties. The improvements are caused by addition to the electroless plating solution of a minor amount of a polymer formed by the polymerization of a 2-acrylamido or methacrylamido alkyl sulfonic acid.

DESCRIPTION OF THE PREFERRED EMBODIMENTS

As aforesaid, the polymers are responsible for the increase in plating rate. Several polymers within the class of polymers that are the subject of the invention are disclosed in U.S. Pat. No. 3,547,899 incorporated herein by reference. The polymers may be formed by polymerizing the 2-acrylamido or methacrylamido alkyl sulfonic acid monomers in the presence of a polymerization catalyst and optionally in the presence of at least one vinyl or vinylidene compound. In accordance with the invention, the monomer corresponds to the following general formula:

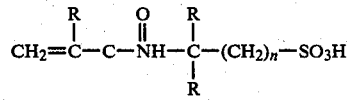

where each R represents hydrogen or lower alkyl having from 1 to 4 carbon atoms and n is a whole integer of from 1 to 3. In the above formula, each R may differ from another.

The activity of the aforesaid monomers is similar to the polymerization properties of vinyl and vinylidene monomers and therefore, copolymers uniform in composition are easy to produce. Suitable comonomers include the conventional vinyl or vinylidene compounds and divinyl compounds such as, for example, ethylene, vinyl acetate, vinyl chloride, vinylidene chloride, styrene, maleic anhydride, acrylic acid, methacrylic acid, acrylates and methacrylates having 1 to 18, preferably 1 to 4 carbon atoms in the alcohol moiety, acrylamide and methacrylamide (meth)acrylmethylamide, (meth)acryldimethylamide, (meth)acrylhydroxyethylamide, butadiene, chlorobutadiene and isoprene.

Polymerization and copolymerization may be carried out under a variety of known conditions in the presence of a variety of radical-forming initiators and initiator systems. Suitable initiators include peroxidic compounds capable of forming radicals, such as hydrogen peroxide, d-tert-butyl peroxide, benzoil peroxide, lauroyl peroxide and cumene hydroperoxide.

The polymerization reaction is carried out at a temperature ranging anywhere from about −15° C. to 200° C. and preferably between 50° C. and 180° C. The polymerization is typically carried out at atmospheric pressure but may be carried out under higher pressure if desired. Further details regarding the polymerization reaction and the types and quantities of comonomers that may be used can be found in the aforesaid U.S. Pat. No. 3,547,899. The procedures for polymerization described in the patent may be used for the polymerization of monomers not disclosed within the patent, but within the scope of the above identified general formula.

The polymer additive described above can be added to any conventional electroless nickel and/or cobalt plating solution. The plating bath typically comprises an aqueous solution containing nickel cations, hypophosphite anions, buffering agents, and stabilizing compounds. The nickel cations are usually derived from nickel salts such as nickel chloride, nickel sulfate, and the like; and the hypophosphite anions from sodium, potassium, lithium and similar hypophosphites or combinations thereof. The hypophosphite is typicaly used in molar excess of the nickel in solution.

The amount of polymer added to solution is not critical dependent upon its solubility in solution. The polymer is added in an amount sufficient to increase plating rate by at least 20% compared to a solution free of polymer. Amounts ranging from about 0.1 grams per liter to the solubility limit of the polymer in solution are acceptable, amounts ranging between 0.2 to 5.0 grams per liter are preferred and amounts ranging between about 0.20 and 1.5 grams per liter are most preferred. As the concentration approaches and exceeds 1.5 grams per liter, the solubility limit of the polymer is approached and solution foaming may be encountered.

Articles that can be plated with the nickel plating solutions of this invention include metals such as iron, cobalt, nickel, and the like, which are catalytic to the nickel within the plating solution; metals such as copper, silver, gold and the like, which may be plated after catalyzation of their surface; and plastics and other materials catalyzed so as to allow electroless deposition of nickel thereon.

The article to be nickel plated is cleaned, and/or otherwise treated in accordance with standard practices employed in the electroless plating arts, such as by catalyzation with palladium and immersion in a suitable volume of the electroless nickel solution of the invention. Prefereably, the bath is heated to effect deposition, preferably to a temperature below its boiling point at atmospheric pressure, typically within a range of 175° F. to 200° F. Deposition of nickel on the immersed article proceeds, as indicated by evolution of hydrogen gas at the surface, until the required thickness of the nickel coating has been deposited. The coated article is removed from the bath and rinsed with water, after which it is ready to use.

The invention will be better understood by reference to the example which follows:

EXAMPLES 1 through 5

Nickel sulfate heptahydrate: 24.0 g/l
Acetic Acid: 2.4 g/l
Lactic Acid: 33.0 g/l
Malic Acid: 20.0 g/l
Itaconic Acid: 3.0 g/l
Potassium Iodate: 0.3 g/l
Sodium Hypophosphite: 40.0 g/l
pH: 4.9
Temperature: 195° F.

Steel coupons of a dimension of 1" by 2" (designated SAE 1020) were cleaned and pickled in a 50% hydrochloric acid solution, rinsed in deionized water and plated by suspending the same in the above nickel plating solution for one hour. The thickness of the deposit was measured using a Magne Gage and found to be 0.46 mil.

To four different beakers containing one liter of the above bath, there was added 0.25, 0.5, 1.0 and 1.5 grams, respectively of poly (2-acrylamido-2-methylpropane sulfonic acid) and the plating procedure described above was repeated for one hour. The results set forth in the following table were obtained:

| Example No. | Grams of Polymer | Thickness (mils) |
|---|---|---|
| 1 | 0.0 | 0.46 |
| 2 | 0.25 | 0.55 |
| 3 | 0.5 | 0.62 |
| 4 | 1.0 | 0.68 |
| 5 | 1.5 | 0.70 |

It was found that as the polymer concentration increased beyond 1.0 grams per liter, the rate did not appreciably increase and foaming was encountered.

We claim:

1. In an electroless nickel solution comprising a source of nickel ions, a reducing agent therefor, a complexing agent and a pH adjustor, the improvement comprising the addition to the electroless plating solution of a polymer consisting of polymerized units of a 2-acrylamido or 2-methacrylamido alkyl sulfonic acid in an amount sufficient to increase the rate of plating.

2. The solution of claim 1 where the monomer corresponds to the formula:

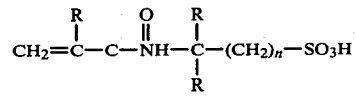

where each R, independent of the other, is H or lower alkyl having up to 4 carbon atoms and n is a whole integer of from 1 to 2.

3. The solution of claim 2 where the monomer is 2-acryloylamido-2,2-dimethylethane-1-sulfonic acid.

4. The solution of claim 1 where the reducing agent is a hypophosphite.

5. The solution of claim 4 where the polymer is poly-(2-acrylamido-2-methyl-1-propane sulfonic acid).

6. The solution of claim 4 where the polymer is poly-(2-methacrylamido-2-methyl-1-propane sulfonic acid).

7. In an electroless nickel plating solution comprising a source of nickel ions, a reducing agent therefor, a complexing agent and a PH adjustor, the improvement comprising the addition to the electroless plating solution of a polymer of copolymerized units of 2-acryloylamido-2,2 dimethylethane-1-sulphonic acid or 2-methacrylamida sulfonic acid and at least one monomer selected from the group consisting of ethylene, vinyl acetate, vinyl chloride, vinylidene chloride, styrene, acrylic acid, methacrylic acid, acrylonitrile, methacrylonitrile, mathacrylic and acrylic acid esters having 1 to 18 carbon atoms in the alcohol moiety acrylamide, methacrylamide (meth)acrylmethylamide, (meth)acrylmethylamide, acrylhydroxyethylamide, (meth)acrylhydroxyethylamide, butadiene, chlorobutadiene and isoprene in an amount sufficient to increase the rate of plating.

8. The solution of claim 4 where the polymer is present in an amount up to saturation.

9. The solution of claim 4 where the polymer is present in an amount sufficient to increase the plating rate by 20% compared to a solution free of polymer.

10. The solution of claim 9 where the concentration of the polymer ranges between 0.1 and 5 grams per liter.

11. The solution of claim 9 where the concentration of the polymer ranges between about 0.20 and 1.5 grams per liter.

12. A process for increasing the rate of deposition of nickel from an electroless nickel plating solution comprising a source of nickel ions, a reducing agent therefor, a complexing agent and a pH adjustor, said process comprising the step of including in said plating solution a polymer of a 2-acrylamido or 2-dimethylamido alkyl sulfonic acid.

13. The process of claim 12 where the monomer corresponds to the formula:

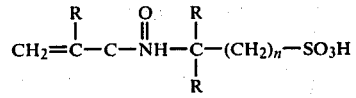

where each R, independent of the other, is H or lower alkyl having up to 4 carbon atoms and n is a whole integer of from 1 to 2.

14. The process of claim 13 where the monomer is 2-acryloylamido-2,2-dimethylethane-1-sulfonic acid.

* * * * *